United States Patent [19]

Pavlicek

[11] 4,267,936

[45] May 19, 1981

[54] REMOTELY OPERABLE LID FOR STORAGE BINS

[75] Inventor: Cleone J. Pavlicek, Morris, Minn.

[73] Assignee: Miles Laboratories, Inc., Elkhart, Ind.

[21] Appl. No.: 93,442

[22] Filed: Nov. 13, 1979

[51] Int. Cl.[3] ..... B65D 43/26

[52] U.S. Cl. ..... 220/262; 220/320; 220/345; 49/360; 49/404; 52/66

[58] Field of Search ..... 220/262, 345, 346, 319, 220/320; 49/360, 404, 324; 52/66, 72

[56] References Cited

U.S. PATENT DOCUMENTS

| | | | |
|---|---|---|---|
| 1,188,289 | 6/1916 | Levan | 52/66 X |
| 1,523,232 | 1/1925 | Massie | 49/360 |
| 2,843,422 | 7/1958 | Black | 52/66 X |
| 3,386,206 | 6/1968 | Loveless | 220/262 X |
| 3,465,483 | 9/1969 | Miller | 52/72 X |
| 3,819,082 | 6/1974 | Rosenvold | 220/262 X |

*Primary Examiner*—George T. Hall

*Attorney, Agent, or Firm*—Edward H. Gorman, Jr.

[57] ABSTRACT

A remotely operable lid for storage bins to be used in conjunction with a storage bin (10) having an access opening (11). A cover plate (18) is carried within a pair of guides (20, 22) such that the plate may be slid laterally in the guides. The guides (20, 22) are held spaced apart by end members (26, 28) which in conjunction with the guides, form a frame. Affixed to the bottom of the frame is a cylindrical band (46) which is sized to accept within a ridge (48) extending upward and around the access opening perimeter of the storage bin. The lid and frame are thus fixed atop the access opening of the bin. Attached to the lid are two eyelets (30, 32) and attached to the frame is a pulley (30). Ropes are attached to the eyelets, one of which is threaded through the pulley. The ropes are extended downward along the side of the bin to ground level. An operator at ground level can then pull one of the ropes to cause the lid to slide over the access opening, and pull the other rope to cause the lid to slide away from the access opening, thereby permitting entry of materials into the bin. The flange extending from the access opening is notched (64, 66, 68) to assure a complete closure of the access opening by the lid.

22 Claims, 8 Drawing Figures

FIG. 1
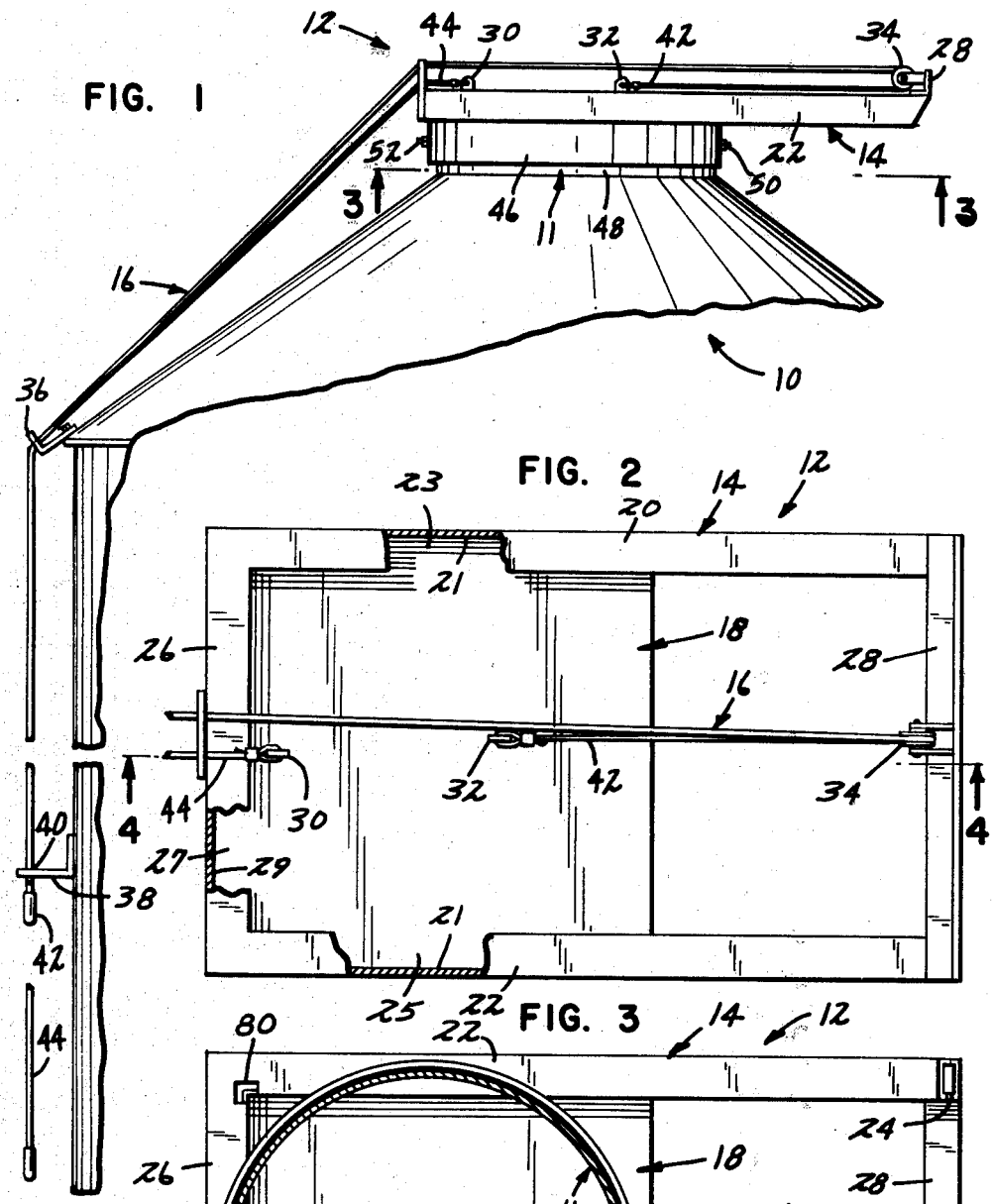
FIG. 2
FIG. 3
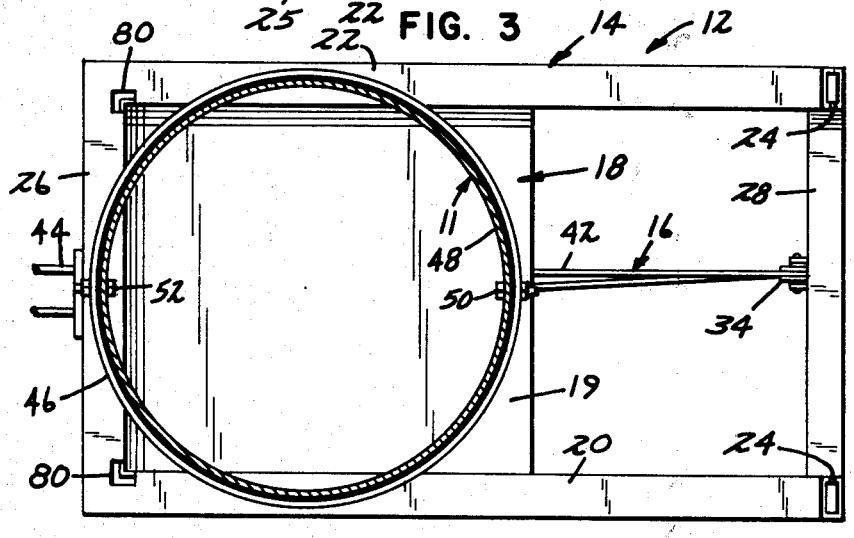

REMOTELY OPERABLE LID FOR STORAGE BINS

TECHNICAL FIELD

The present invention relates to lids for storage bins, more particularly, a lid which may be operated from a place remote from its location.

BACKGROUND OF THE INVENTION

Storage facilities used on a farm such as silos and grain storage bins typically have round access openings located at the apex of their roof. Traditionally, this opening has been covered by some sort of covering disc which is usually hinged so that it may be manually opened. Unfortunately, this arrangement requires the user to climb up a ladder, usually provided for, to open and close the opening as needed. This procedure is both time consuming and potentially dangerous. In order to overcome this problem, a device has been needed to permit the operator to remotely open and close this access opening from ground level. Furthermore, this device must be inexpensive to manufacture, reliable and adaptable for use on already existing bins. The present invention provides all of these advantages and overcomes the disadvantages of prior art systems.

SUMMARY OF THE INVENTION

The present invention comprises a remotely operable lid apparatus for use with a storage bin including a cover plate, a pair of guides for carrying the edges of the plate such that the plate may slide laterally within the guides, means for remotely moving the plate so as to open and close the opening, and means for attaching the guides to the bin over the opening, including a band shaped member to encompass a ridge around the access opening of the lid.

According to another feature of the invention, pulleys and cables are used for remotely moving the plate within the guide members.

The invention may be made adaptable to existing bins or made an integral part of new bins.

Various advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there are illustrated and described preferred embodiments of the invention.

BRIEF DESCRIPTION OF THE DRAWINGS

Referring to the drawings, wherein like numerals indicate like elements:

FIG. 1 is a fragmentary side elevational view of a storage bin with the present invention mounted thereon;

FIG. 2 is a top plan view of a portion of FIG. 1;

FIG. 3 is a horizontal section as seen from line 3—3 of FIG. 1;

DETAILED DESCRIPTION OF THE INVENTION

Figures 4, 5, 6, 7, 8:
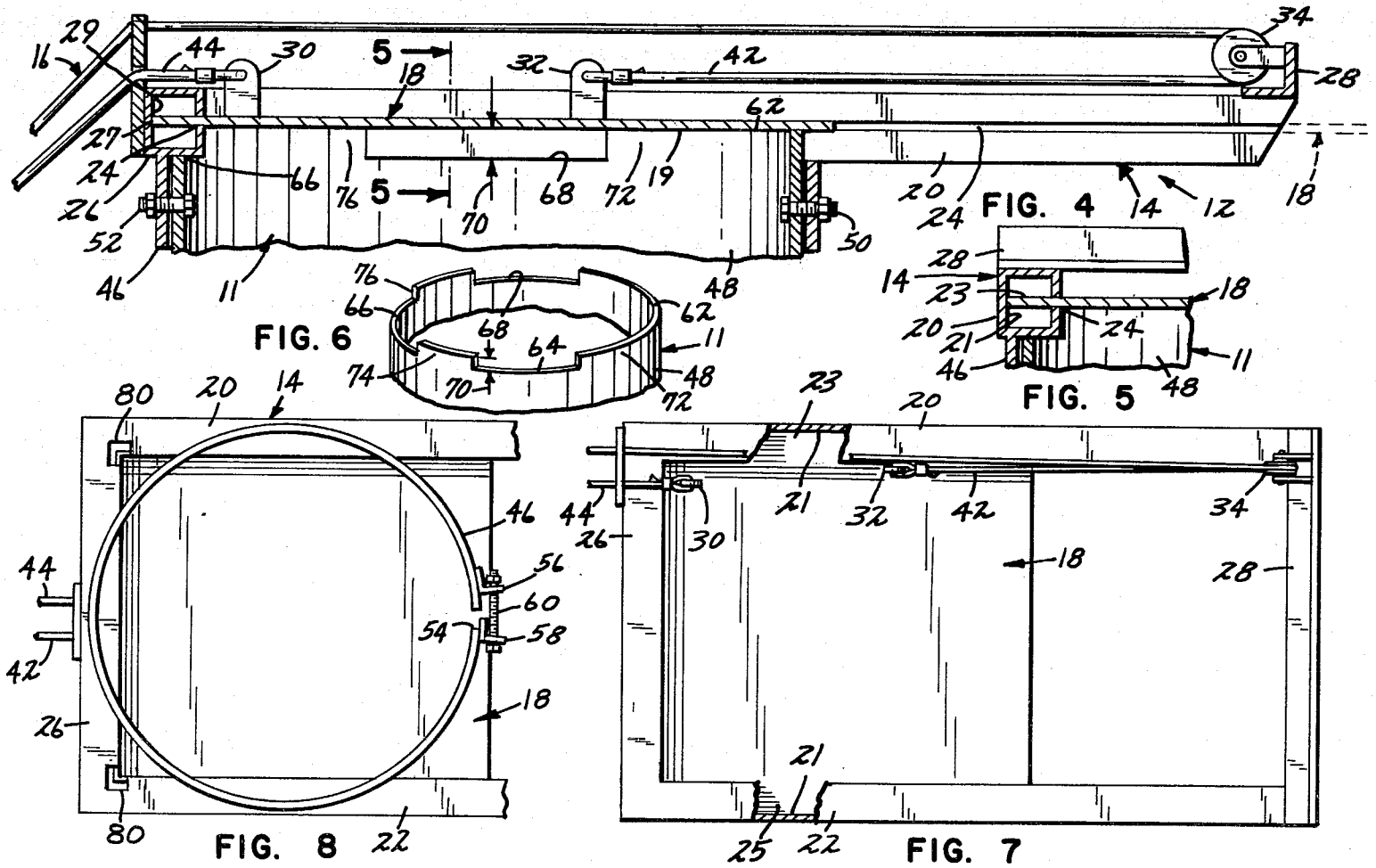
FIG. 4 is a view in vertical section as seen from line 4—4 of FIG. 2.
FIG. 5 is a vertical detailed section as seen from line 5—5 of FIG. 4.
FIG. 6 is a fragmentary view in perspective showing part of a storage bin.
FIG. 7 is a plan view showing an alternative embodiment of the invention.
FIG. 8 is a top plan view showing an alternative form of the present invention.

Referring to the drawings in detail, there is shown in FIG. 1 a storage bin 10 with an access opening 11 and a remotely operable lid apparatus generally designated by the numeral 12 mounted thereon. The lid apparatus 12 includes a lid carrying mechanism 14 shown in greater detail in FIGS. 2–5, and a rope and pulley arrangement 16. As seen in FIGS. 2–5, lid carrying mechanism 14 includes a cover plate 18 having a bottom face 19, and edges 23, 25 and 29, which is carried in slidable engagement with guides 20 and 22. Guides 20 and 22 are box-shaped with a gap 24 in an inner wall of the guide. Gap 24 is sufficiently wide to admit cover 18 therewithin. Guides 20 and 22 are held spaced apart a fixed distance by end members 26 and 28. Member 26 is shaped like guides 20 and 22 having a gap 24 therein. Members 26 and 28 and guides 20 and 22 are joined so as to create an outer rectangular perimeter in which cover 18 is confined. The spacing of guides 20 and 22 and therefore the length of members 26 and 28 is defined as sufficiently wide such that the outer edges 23 and 25 of cover 18 extend beyond gap 24 and into the interior of guides 20 and 22 but not in tight abutment with the inner walls 21 of the guides 20 and 22. It is desirable to make cover 18 as wide as possible without exceeding the above-defined limitations in order to prevent binding of the lid by a torqueing force which may cause it to bind on the guides when the lid is opened or closed. Also, ridge 27 of the cover is received within slot 24 within the member 26 and contacts an inner surface 29 thereof when the cover 18 is fully closed. See FIGS. 2 and 4

Mounted on cover 18 are eyelets 30 and 32 which are preferably welded to the top surface of cover 18. The eyelets may be located toward opposite edges of cover 18. Mounted on end member 28 is a fixed pulley 34. Mounted on a side wall of bin 10 is bracket 36 having two holes (not shown) drilled therein about 100 mm apart as guides for ropes 42 and 44 described hereinafter. Further down the wall of bin 10 may be mounted a cord guide 38 with an aperture 40 therein for receiving a rope or cord.

A pair of ropes 42 and 44 are used for remotely moving cover 18 so that storage bin access opening 11 can be opened and closed. Rope 42 is attached at one end to eyelet 32, then threaded around pulley 34, through one hole in guide 36, through the aperture 40 in guide 38 and finally extends downward to a point reachable by a person standing on the ground. The second length of rope 44 is attached to eyelet 30 and is similarly routed through the other hole in guide 36 and through aperture 40 in guide 38 to a point reachable from an operator on the ground.

In operation, rope 44 is drawn downward in order to cause cover 18 to slide over access opening 11 of bin 10. Pulling rope 42 causes cover 18 to move within guides 20 and 22 so as to uncover access 11 permitting the entry or removal of materials within bin 10.

In order to attach lid carrying mechanism 14 to bin 10, a steel rim 46 is welded to the bottom sides of guides 20 and 22 and end member 26 at points where the rim comes in contact with these members. In one embodiment, as shown in FIG. 3, rim 46 is sized to snugly receive flange 48 of bin 10 which extends vertically from access opening 11 of bin 10. Fasteners 50 and 52 may be used to secure steel rim 46 to flange 48, although if rim 46 and flange 40 are properly sized they are unnecessary. In another embodiment of the invention, shown in FIG. 8 of the drawings, steel rim 46 is split at point 54 and a small section of the rim is removed so that the ends of the rim do not touch each other at point 54. Attached at the end of rim 46 on both sides of point 54 are right angle members 56 and 58 which are welded to rim 46. Members 56 and 58 are bored to receive adjustable fasteners 60. After the rim is placed concentrically around over flange 48, fastener 60 is tightened thereby bringing members 56 and 58 closer to each other, tightening rim 46 around flange 48.

In order to assure that cover 18 seals tightly against the top edge 62 of flange 48, notches 64, 66 and 68 are cut into flange 48. The notches are cut from edge 62 of flange 48 and extend downward a distance equal to the distance from cover 18 to the bottom edge of guide 20 or 22. Distance 70 shown in FIGS. 4 and 6 delineates this distance. When lid carrying mechanism 14 is set in place on bin 10 over access 11 with rim 46 concentrically aligned around flange 48, edges 72, 74 and 76 will define a plane parallel and just slightly below the bottom face 19 of cover 18. This will result in a seal against all but the smallest particulate matter entering access 11 when cover 18 is in its closed position.

Another embodiment of this invention is shown in FIG. 7 of the drawings. In order to accommodate the entry of large pieces of material entering the access, such as corn cobs or the like, it may be desirable to move eyelets 30 and 32 from the center of cover 18 to points closer to guide 20 or 22. Similarly pulley 34 must be moved in alignment with the eyelets. Because pulling cover 18 from a point off its center may cause a turning torque, it is desirable to have the edges 23 and 25 of cover 18 which are carried in guides 20 and 22 to come as close to abutment with the inner walls 21 of the guides as possible as shown in FIG. 5. This will result in the least possible binding by preventing any substantial turning of cover 18 which might result in binding at points along wall 21.

To prevent accumulation of rain water within guides 20 and 22 and member 24, drain holes 80 are cut into the bottom face of these members as shown in FIGS. 3 and 8. The other end of guides 20 and 22 (adjacent member 28) is open to allow drainage at that end.

Although other materials may be used, number 10 gauge steel is preferred.

Numerous characteristics and advantages of the invention have been set forth in the foregoing description, together with details of the structure and function of the invention, and the novel features thereof, which are pointed out in the appended claims. The disclosure, however, is illustrative only, and changes may be made in detail, especially in matters of shape, size and arrangement of parts within the principle of the invention to the full extend intended by the broad general meaning of the terms in which the appended claims are expressed.

What is claimed is:

1. A storage bin having a remotely operable lid comprising:

(a) an enclosure for storing materials, said enclosure having an opening for admitting the materials into the enclosure, said opening having a ridge extending outwardly from said enclosure and around the periphery of said opening;

(b) a remotely operable lid apparatus including a cover plate, a pair of guides for carrying edges of said plate and allowing said plate to slide laterally within said guides;

(c) means for remotely operating said lid;

(d) means for attaching said lid apparatus to said enclosure including a band-shaped member to encompass said ridge, said band being fastened to said apparatus, and means for attaching said band to said ridge.

2. A storage bin having a remotely operable cover comprising:

(a) an enclosure for storing materials having an access opening for admitting the materials into said enclosure;

(b) a flange extending outwardly and around the periphery of said opening;

(c) first and second quide members disposed parallel to each other, said first guide located on one side of said opening and said second guide located on the other side of said opening, said guide member being shaped to define an interior region and having a longitudinal gap in each of said guide members;

(d) adapter means for attaching said guide to said flange;

(e) a cover plate having longitudinal edges larger than said opening, each longitudinal edge extending into one of said longitudinal gaps and being carried within said guide members in sliding engagement with said guide members; and (f) pulley means for remotely moving said cover plate along said guide members from a position wherein the opening is fully opened to a position wherein said plate fully covers said opening.

3. A storage bin according to claim 2 wherein said adapter means includes a cylindrically shaped band member adapted to engage the outer perimeter of said flange.

4. A storage bin according to claim 3 wherein said band is continuous.

5. A storage bin according to claim 3 wherein said band has a longitudinal gap therein to define a discontinuous cylinder and includes brackets attached to the ends of said band, each of said brackets having a boring therethrough for receiving a fastener so that said band may be engaged against said perimeter when said fastener is received within said borings and tightened to draw said ends toward each other.

6. A storage bin according to claim 2 including first and second end members attached to guides to form a frame for carrying said cover plate, said first end member being of the same shape as said guide members and having a gap therein for receiving said cover plate when said cover plate is disposed over said access opening.

7. A storage bin according to claim 2 wherein said flange contains notches in its top edge whereby said top edge is in abutment with said lid when said lid is covering said access.

8. A storage bin according to claim 7 wherein said notches are cut to a depth approximately equal to the distance from said cover plate to the outer edge of said guide members.

9. A storage bin according to claim 8 wherein said notches include first, second and third notches, said first notch being located in said flange such that a portion of said first end member may be received therein, said second and third notches being located in said flange such that a portion of each of said guide members is respectively received therein.

10. A remotely operable lid apparatus for use with a storage bin having an access opening therein comprising:

(a) a cover plate quadilateral in shape for covering said access opening, said cover plate having two parallel sides;

(b) a cover plate carrying mechanism for moving said cover plate between a closed position covering said access and an open position wherein said access is unobstructed, including:

(1) a parallel pair of box-shaped guides spaced apart, one face of each of said guides having a gap therein sized to receive said sides of said cover plate;

(2) a pair of end members affixed to ends of said guides for holding said guides spaced apart and for providing end limits on the movement of said cover plate at said open and closed positions;

(c) means for remotely moving said cover plate between open and closed positions including:

(1) at least one cord;

(2) means located on said cover plate for attaching said cord to said cover plate;

(3) cord guide means for guiding said cord from said cover plate to a point reachable by an operator standing on the ground;

(d) adapter means affixed to said lid carrying mechanism for securing said mechanism to said bin around said access opening.

11. An apparatus according to claim 10 wherein said cord guide means includes a first pulley mounted on one of said end members and a cord guide member mounted on said bin.

12. A remotely operable lid apparatus according to claim 10 wherein said adapter means includes a band having opposite ends, said band being formed into the shape of a cylinder, the ends of said band having means for being drawn tightly toward each other so that said band is engaged around a flange extending from and around said access on said bin.

13. A lid apparatus according to claim 12 wherein said drawing means includes brackets having an aperture affixed to said ends and an adjustable fastener extending through said brackets whereby said band is biased against the flange when said fastener is tightened.

14. A lid apparatus according to claim 10 wherein said adapter means includes a cylindrical member having an inner diameter approximately equal to the diameter of a flange extending from and around said access on said bin.

15. A lid apparatus according to claim 14 wherein said cylindrical member includes apertures for receiving fasteners for securing said member to the flange.

16. A lid apparatus according to claim 10 wherein said cord attaching means includes eyelets affixed to said cover.

17. A lid apparatus according to claim 10 wherein each of said guides includes an inner surface opposite said gap and wherein said sides of said cover plates ride along said inner surfaces.

18. A lid apparatus according to claim 10 wherein at least one of said end members is box-shaped and has a gap therein sized to receive said sides of said cover plate and wherein a portion of said cover plate is received within said gap when in said closed position.

19. A lid apparatus according to claim 10 wherein said attaching means includes at least one eyelet attached to said cover plate.

20. A lid apparatus according to claim 11 wherein said attaching means and said first pulley means are located toward one of said guides.

21. A lid apparatus according to claim 10 wherein said lid carrying mechanism includes means for draining fluids which may accumulate in said mechanism.

22. A lid apparatus according to claim 21 wherein said draining means includes apertures in said box shaped guides.

* * * * *

UNITED STATES PATENT AND TRADEMARK OFFICE

CERTIFICATE OF CORRECTION

PATENT NO. : 4,267,936

DATED : 19 May 1981

INVENTOR(S) : Cleone J. Pavlicek

It is certified that error appears in the above—identified patent and that said Letters Patent is hereby corrected as shown below:

On page 1,please delete "[73] Assignee: Miles Laboratories, Inc., Elkhart, Ind."

Signed and Sealed this

*Fifth* Day of *October 1982*

[SEAL]

*Attest:*

GERALD J. MOSSINGHOFF

*Attesting Officer*

*Commissioner of Patents and Trademarks*